US009780430B2

(12) United States Patent
Günther et al.

(10) Patent No.: US 9,780,430 B2
(45) Date of Patent: Oct. 3, 2017

(54) TERMINAL CONNECTION COMPRISING AN HF CONDUCTOR, IN PARTICULAR FOR A COAXIAL CABLE, AND METHOD FOR PRODUCING SAID TERMINAL CONNECTION

(71) Applicant: KATHREIN-WERKE KG, Rosenheim (DE)

(72) Inventors: Mario Günther, Kolbermoor (DE); Thomas Haunberger, Bad Reichenhall (DE); Johannes Schaller, Rosenheim (DE); Manfred Stolle, Bad Aibling (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 15/148,335

(22) Filed: May 6, 2016

(65) Prior Publication Data

US 2016/0329619 A1 Nov. 10, 2016

(30) Foreign Application Priority Data

May 7, 2015 (DE) ..... 10 2015 006 070

(51) Int. Cl.
*H01P 5/08* (2006.01)
*H01P 1/04* (2006.01)
(Continued)

(52) U.S. Cl.
CPC ..... *H01P 5/08* (2013.01); *H01P 1/045* (2013.01); *H01P 1/202* (2013.01); *H01P 11/007* (2013.01); *H01R 4/024* (2013.01); *H01R 9/05* (2013.01)

(58) Field of Classification Search
CPC ..... H01R 4/02; H01R 4/022; H01R 4/023; H01R 4/024; H01R 4/027; H01R 4/625;
(Continued)

(56) References Cited

U.S. PATENT DOCUMENTS 4,487,999 A * 12/1984 Baird ..... G02B 6/4248 174/50.55
4,902,989 A * 2/1990 Glaab ..... H03H 7/48 333/100
(Continued)

FOREIGN PATENT DOCUMENTS

CN 1652404 A 8/2005
CN 101015097 A 8/2007
(Continued)

OTHER PUBLICATIONS

Wikipedia—Beryllium Copper, http://en.wikipedia.org/wiki/Beryllium_copper, Accessed on Feb. 27, 2017.*
(Continued)

*Primary Examiner* — Benny Lee
*Assistant Examiner* — Jorge Salazar, Jr.
(74) *Attorney, Agent, or Firm* — Nixon & Vanderhye P.C.

(57) ABSTRACT

A terminal connection comprises an HF conductor and a terminal apparatus. The terminal apparatus comprises an HF conductor receiving element comprising an HF conductor receiving hole. At least one solder deposit is arranged between the HF conductor and the HF conductor receiving element of the terminal apparatus to establish an electrically conductive connection. There is also an insertion sleeve comprising a receiving opening into which the HF conductor is inserted. The insertion sleeve is inserted into the HF conductor receiving hole in the HF conductor receiving element via an insertion opening on the plug-in side. The insertion sleeve is undeformable and/or is formed from a dielectric. It may also be adapted, in terms of the circumferential lateral face thereof, to an inner face of the HF conductor receiving hole. It may also comprise a receiving channel, which is used for receiving the at least one solder deposit.

19 Claims, 11 Drawing Sheets

(51) Int. Cl.

| | |
|---|---|
| ***H01R 4/02*** | (2006.01) |
| ***H01P 1/202*** | (2006.01) |
| ***H01P 11/00*** | (2006.01) |
| *H01R 9/05* | (2006.01) |

(58) Field of Classification Search
CPC ..... H01R 4/723; H01R 9/05; H01P 1/202; H01P 11/007; H01P 5/08; H01P 1/045
USPC ..... 333/260; 439/874
See application file for complete search history.

(56) References Cited

U.S. PATENT DOCUMENTS

| | | | | |
|---|---|---|---|---|
| 5,046,966 | A * | 9/1991 | Snyder | H01R 13/65802 439/579 |
| 6,118,353 | A * | 9/2000 | McKay | H01P 5/16 333/125 |
| 2010/0144200 | A1 | 6/2010 | Holliday | |

FOREIGN PATENT DOCUMENTS

| | | |
|---|---|---|
| DE | 693 07 329 | 8/1997 |
| DE | 102 51 905 | 6/2012 |
| WO | WO 2015/000749 | 1/2015 |

OTHER PUBLICATIONS

Office Action dated Mar. 3, 2017, issued in related Chinese Patent Application No. 201610298054.X.

* cited by examiner

TERMINAL CONNECTION COMPRISING AN HF CONDUCTOR, IN PARTICULAR FOR A COAXIAL CABLE, AND METHOD FOR PRODUCING SAID TERMINAL CONNECTION

CROSS-REFERENCE TO RELATED APPLICATIONS

This application claims priority to DE Patent Application No. 10 2015 006 070.8 filed 7 May 2015, the entire content of which is hereby incorporated by reference.

STATEMENT REGARDING FEDERALLY SPONSORED RESEARCH OR DEVELOPMENT

None.

FIELD

The invention relates to a terminal connection for receiving and contacting for HF conductors, in particular for those of a coaxial cable.

BACKGROUND

Terminal connections, like plug-in connections in general, are used for isolating and connecting electrical lines so as to transmit current and/or in particular electrical signals therethrough. These may be multiple or single plugs. Coaxial plug-in connections are of great importance in the field of plug-in connectors, which connections comprise an inner conductor, an outer conductor and generally an outer conductor shield, the inner conductor being electrically/galvanically isolated from the outer conductor generally using a dielectric.

In the process, it is desirable to be able to bring the coaxial cable into contact with the plug-in connector in as simple a manner as possible. This contact should be as reproducible as possible.

DE 693 07 329 T2 describes a terminal device for a cable. The terminal device comprises a connector which has a hollow region into which a solder deposit is introduced. Subsequently, an electrically conductive, resilient, sleeve-shaped compression coil is inserted. The inner conductor to be contacted of the cable to be received is inserted into this compression coil.

US 2010/0144200 A1 discloses a connector which can be used for terminating a coaxial cable. The connector comprises a holding apparatus against which a spring is supported by its first end. In addition, the spring in part abuts an inner wall of a receiving hole in the connector in the circumferential direction. The spring comprises a second end and tapers in diameter from the first end to the second end. The inner conductor of the coaxial cable to be received is introduced through the holding apparatus and held in a centred manner in the hole by the second end of the spring.

WO 2015/000749 discloses a terminal plug for a coaxial cable. The terminal plug comprises a holding element and a contacting element. The holding element consists of a dielectric and holds an inner conductor of the coaxial cable to be received in a centred manner in a receiving opening in the terminal plug. The contacting element contacts the inner conductor galvanically, and is additionally supported against the holding element. Protruding portions on the outer circumference of the contacting element, which engage in corresponding indentations in the holding element, prevent axial displacement of the contacting element with respect to the holding element.

DE 102 51 905 C5 discloses a plug-in connection consisting of a coaxial plug-in connector and a coaxial cable to be received. The plug-in connector comprises an outer conductor socket, which is used for contacting an outer conductor of the coaxial cable to be received. The plug-in connector also comprises an inner conductor receiving element, which has an inner conductor receiving hole. This inner conductor receiving element is used for receiving an inner conductor of the coaxial cable to be received. To establish electrical contact between the inner conductor of the coaxial cable to be received and the inner conductor receiving element of the plug-in connector, a solder deposit is arranged within the plug-in connector. The solder deposit may for example be arranged within the inner conductor receiving hole. However, the inner conductor receiving hole may also comprise a region having an expanded diameter, in which case the solder deposit is arranged within this region. After the exposed inner conductor of the coaxial cable is introduced into the plug-in connector, the solder deposit can be melted, for example using an induction loop, causing an electrically conductive connection to be established between the inner conductor of the coaxial cable and the inner conductor receiving element of the plug-in connector.

A drawback of DE 102 51 905 C5 is that different inner conductor receiving holes have to be provided for different diameters of the inner conductor to be received. In addition, a region having an expanded diameter is required in order to attach the solder deposit, and this requires an additional machining step. This makes the production process expensive.

The object of the present invention is therefore to provide a terminal connection by way of which a terminal apparatus can be connected to an HF inner conductor in as simple a manner as possible, even with different cables. The electrical contact between the HF inner conductor and the terminal apparatus should also be reproducible and as simple as possible to implement.

The object is achieved by the terminal connection described herein. This specification also describes an electronic device, in particular an HF filter, which comprises the terminal connection according to the invention. This specification additionally describes a method for producing a terminal connection of this type. Advantageous developments of the terminal connection or the electronic device or the method according to the invention for producing a terminal connection of this type can be found in the description.

The terminal connection according to the invention makes it possible to receive and contact an HF conductor with a terminal apparatus, for example in the form of a plug-in connector. The terminal apparatus comprises an HF conductor and an HF conductor receiving element comprising an HF conductor receiving hole for receiving the HF conductor. The terminal connection also provides the use of at least one solder deposit, which is used for establishing an electrically conductive connection between the HF conductor and the HF conductor receiving element of the terminal apparatus.

The terminal connection also provides an insertion sleeve, which has a receiving opening. The HF conductor is inserted into the receiving opening. The insertion sleeve is inserted into the HF-conductor receiving hole in the HF conductor receiving element via an insertion opening on the plug-in side. The at least one solder deposit is arranged in the insertion sleeve or on at least one of the two end faces of the insertion sleeve or on the HF conductor. The insertion sleeve is undeformable and/or consists of a dielectric. In addition or alternatively, the circumferential side face of the insertion sleeve is adapted to and supported against an inner face of the HF conductor receiving hole, and said sleeve is only displaceable in the longitudinal direction within the HF conductor receiving hole. In addition or alternatively, the insertion sleeve comprises at least one receiving channel, which extends inwards into the receiving opening, the at least one receiving channel being used for receiving the at least one solder deposit.

It is particularly advantageous to use an insertion sleeve which is inserted into the HF conductor receiving hole in the HF conductor receiving element. This insertion sleeve may comprise a solder deposit directly or a solder deposit may be arranged on the insertion sleeve, in other words adjacent thereto. When this solder deposit is melted, the HF conductor is thus connected to the HF conductor receiving element. On the one hand, the insertion sleeve causes the solder deposit to be arranged at a precisely stipulated location, resulting in precise and reproducible contacting of the HF conductor with the HF conductor receiving element. On the other hand, it is ensured that the same terminal apparatus can be used for different diameters of the HF conductor. It is merely necessary to use a different insertion sleeve having a different receiving opening adapted to the HF conductor to be received in each case. As a result, although the insertion sleeves have different diameters in terms of their receiving openings, they nevertheless have the same external diameter, meaning that a standard HF conductor receiving hole can be used. In addition, it is always possible to use fresh solder since it is not arranged within the HF conductor receiving hole, where it would age until the soldering process. The terminal apparatus itself can therefore be stored for as long as is desired, and is only provided with an insertion sleeve, which preferably has a fresh or unaged solder deposit, during the process of being joined to the HF conductor.

In the context of the invention, it is therefore apparent that the terminal apparatus is equally suitable for receiving inner conductors of different diameters.

In another independent claim, an electronic device, which is in particular an HF filter, comprises the terminal apparatus according to the invention. The HF conductor receiving hole, into which the insertion sleeve is introduced together with the solder deposit, is for example formed in a resonator inner conductor of the HF filter. Finally, the HF conductor is inserted into the insertion sleeve and soldered to the HF conductor receiving element.

A further advantage is provided if the insertion sleeve is undeformable, in other words non-resilient, since this causes the distance between the HF conductor and the HF conductor receiving element to be constant and ensures high reproducibility of the soldering point. In this context, the insertion sleeve consists of a dielectric, in particular a plastics material. A plastics material has a low heat capacity, meaning that less energy is required during inductive heating of the solder deposit or that the melting process can take place in a shorter time than if the insertion sleeve were made of a metal, this being another possibility. In addition, the circumferential side face of the insertion sleeve is adapted to the inner face of the HF conductor receiving hole, specifically both in diameter and in shape, and said sleeve is therefore supported against it and is only displaceable in the longitudinal direction within the HF conductor receiving hole. The insertion sleeve and the HF conductor receiving element, which comprises the HF conductor receiving hole, are two separate elements. This means that the insertion sleeve and the HF conductor receiving element are formed as two parts. The HF conductor receiving hole is left unchanged by the attachment of the insertion sleeve.

A further advantage is provided if the solder deposit consists of a rigid or resilient material and is preferably in the form of a partially open or closed ring, or if the solder deposit is viscous. In particular the use of a solder deposit that consists of a rigid or resilient material in the form of an open or closed ring means that this solder deposit can be placed on the HF conductor in a very simple manner.

The insertion sleeve preferably also comprises at least one coding element on the circumference thereof, meaning that the insertion sleeve can only be inserted into the HF conductor receiving element in a particular position in a twist-proof manner. The insertion sleeve may optionally or additionally also comprise, on the circumference thereof, at least one portion which projects into the HF conductor receiving element counter to the insertion direction and acts as a barb, preventing the insertion sleeve from sliding out of the HF conductor receiving element. This means that the solder deposit is always inserted into the terminal apparatus together with the insertion sleeve in the same position. The coding element may also be provided by way of the shape of the insertion sleeve. If the insertion sleeve has an oval or n-gon cross section, n being ≥3, instead of a round cross section, this is already sufficient to prevent rotation. However, the HF conductor receiving hole then has to be produced by a different process. This further increases the reproducibility of the electrical contacting. The fact that the insertion sleeve comprises a type of barb additionally results in simplified assembly, since the insertion sleeve can no longer slide out of the HF conductor receiving hole.

The insertion sleeve is preferably arranged in a manner limited by a stop within the HF conductor receiving element, in such a way that the reproducibility of the electrical contacting is also increased, because the distance between the at least one solder deposit and the HF conductor receiving element is the same for a large number of terminal apparatuses.

The receiving channel is in particular in the form of a hole. The receiving channel preferably extends radially inwards from the outside into the receiving opening, the at least one receiving channel being used for receiving the at least one solder deposit. In this context, it is particularly advantageous that the insertion sleeve can be prepared appropriately together with the solder deposit until the terminal apparatus is finally joined to the HF conductor.

It is also possible for the insertion sleeve to have X receiving channels, X being ≥2, these receiving channels being arranged so as to be spaced apart by $\alpha=360°/X$ in a plan view of a cross section through the insertion sleeve. This means that the HF conductor is electrically contacted with the HF conductor receiving element symmetrically, increasing the reproducibility of the electrical connection.

It is also possible for the receiving channel to be in the form of a cut-out that covers a range of more than 180°, preferably more than 220°, more preferably more than 260°, more preferably more than 300°, more preferably more than 340°, but less than 360° in a plan view of a cross section through the insertion sleeve. A solder deposit which is in the form of an open ring and consists of a rigid or partially resilient material can be arranged within this cut-out in a particularly simple manner. This solder deposit can be "clipped" into the receiving channel in the form of a cut-out in a simple manner.

In addition, the HF conductor is enclosed over at least part of the length thereof by a rigid dielectric, which is enclosed over at least part of its length by an outer conductor, in such a way that the HF conductor forms the inner conductor of a coaxial cable which is to be or has been received. In this case, the terminal apparatus is a plug-in connector. The plug-in connector comprises an outer conductor socket for receiving the coaxial cable. The outer conductor socket comprises an outer conductor contacting portion, on which the outer conductor of the coaxial cable which is to be or has been received is electrically contacted with the outer conductor socket of the terminal apparatus. In this case, the terminal connection comprises at least one adapter element. The at least one adapter element is arranged between the outer conductor contacting portion and the HF conductor receiving element, and encloses the HF conductor, preferably radially, either alone or together with the dielectric of the coaxial cable which is to be or has been received. As a result, the surge impedance of the coaxial cable can be adjusted to a desired value.

The method according to the invention for producing a terminal connection comprises the following method steps. In a first method step, the HF conductor to be received has to be prepared. This can be done by:

a) placing a solder deposit on the HF conductor and further placing the insertion sleeve on the HF conductor, either in succession or simultaneously; or
b) placing the insertion sleeve and a solder deposit on the HF conductor, either in succession or simultaneously; or
c) placing the insertion sleeve on the HF conductor, the at least one solder deposit already being arranged in the insertion sleeve; or
d) placing the insertion sleeve on the HF conductor and attaching the at least one solder deposit in the insertion sleeve.

Subsequently, the HF conductor is inserted into the HF conductor receiving element of the terminal apparatus, together with the insertion sleeve and the at least one solder deposit.

Instead of the first method step, the terminal apparatus may be appropriately prepared in a second method step. This is done by:

a) arranging the at least one solder deposit in the insertion sleeve and inserting the insertion sleeve into the HF conductor receiving hole in the HF conductor receiving element of the terminal apparatus together with the at least one solder deposit; or
b) inserting the insertion sleeve into the HF conductor receiving hole in the HF conductor receiving element of the terminal apparatus and inserting or introducing a solder deposit into the space, remaining towards the insertion opening, in the HF conductor receiving hole in the HF conductor receiving element of the terminal apparatus; or
c) inserting a solder deposit into the HF conductor receiving hole in the HF conductor receiving element of the terminal apparatus, and further inserting or introducing the insertion sleeve into the HF conductor receiving hole in the HF conductor receiving element of the terminal apparatus.

Subsequently, the HF conductor is inserted into the receiving opening in the insertion sleeve or into the receiving opening in the insertion sleeve and the annular solder deposit.

Instead of the first method step or the second method step, both the coaxial cable and the terminal apparatus may be appropriately prepared in a third method step. This is done by:

a) inserting the insertion sleeve into the HF conductor receiving hole in the HF conductor receiving element of the terminal apparatus and placing a solder deposit on the HF conductor, either in succession or simultaneously.

Subsequently, the HF conductor is inserted into the receiving opening in the insertion sleeve.

In a fourth method step, the solder deposit is heated until it is melted into a liquid. Electrical contact between the HF conductor and the HF conductor receiving element is thus established. It is particularly advantageous that on the one hand the insertion sleeve can be slipped over the HF conductor or on the other hand the insertion sleeve can be inserted into the HF conductor receiving hole in the HF conductor receiving element. This makes it possible either for the HF conductor to be prepared as a separate element together with the insertion sleeve and the solder deposit, or for the terminal apparatus to be prepared together with the insertion sleeve and optionally the solder deposit.

BRIEF DESCRIPTION OF THE DRAWINGS

Various embodiments of the invention are described in the following by way of example with reference to the drawings. Like items have like reference numerals. Specifically, in the corresponding figures of the drawings.

DETAILED DESCRIPTION OF PREFERRED EMBODIMENTS

Figure 1A:
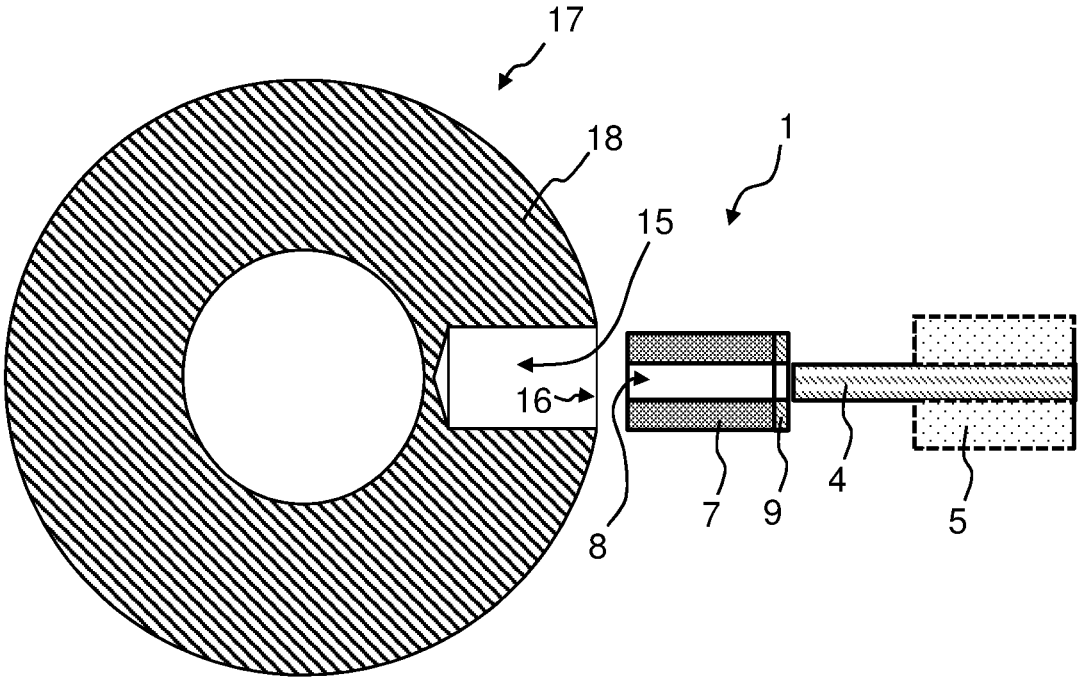
FIG. 1A is a simplified sectional view of an electrical device in which the terminal connection according to the invention is used for receiving and contacting an HF conductor.

FIG. 1A is a simplified sectional view of an electrical device 17 in which the terminal connection 1 according to the invention is used for receiving and contacting an HF conductor 4. An electrical device 17 may for example be an HF filter which alters an electrical signal. Depending on the construction, an HF filter of this type comprises for example a resonator inner conductor 18, as is shown in FIG. 1A. A resonator inner conductor 18 of this type preferably extends from a housing base to a housing cover. Resonator inner conductors 18 of this type are not only capacitive, coupled in a contactless manner, but also galvanic or inductive, depending on the application. The signal to be input or decoupled is supplied via an electrical line, in other words an HF conductor 4. To make it as easy as possible to calibrate the electrical device 17, in other words the HF filter, reproducible soldered connections are required.

FIG. 1A shows how an HF conductor 4 can be connected to the resonator inner conductor 18 rapidly, simply, and reproducibly in terms of its electrical properties, using the terminal connection 1 according to the invention. In the simplest case, the HF conductor 4 consists of a single wire or a strand. It is indicated in dashed lines that the HF conductor 4 may be enclosed by a dielectric 5. In the further embodiments, described in the subsequent drawings, the HF conductor 4 is an inner conductor 4 of a coaxial cable 3.

The resonator inner conductor 18 comprises a terminal apparatus 2, which comprises an HF conductor receiving element 10 comprising an HF conductor receiving hole 15. An HF conductor receiving hole 15 is made in the resonator inner conductor 18, and in this case also forms the HF conductor receiving element 10. It is possible for the HF conductor receiving hole 15 to be galvanised together with the HF filter for better electrical contacting.

The terminal connection 1 further comprises an insertion sleeve 7, which has a receiving opening 8 into which the HF conductor can be or is inserted.

In order for the HF conductor 4 to be contactable with the resonator inner conductor 18, the terminal connection 1 further comprises at least one solder deposit 9 for establishing an electrically conductive connection. In the embodiment of FIG. 1A, the at least one solder deposit 9 is arranged on an end face of the insertion sleeve 7. The at least one solder deposit 9 can be firmly pressed to the insertion sleeve 7. The insertion sleeve 7 can be inserted into the HF conductor receiving hole 15 in the HF conductor receiving element 10 alone or together with the at least one solder deposit 9.

The external diameter of the insertion sleeve 7 is preferably selected in such a way that the insertion sleeve 7 fits frictionally or positively in the HF conductor receiving hole 15 and can only be moved axially, in other words in the direction of an insertion opening 16 on the plug-in side or counter to this insertion opening 16 on the plug-in side. This means that the shape of the lateral circumferential wall of the insertion sleeve 7, which does not include the end faces, is adapted to the shape of the internal peripheral wall of the HF conductor receiving hole 15.

The insertion sleeve 7 preferably consists of a plastics material and is undeformable. This ensures that the distance between the HF conductor 4 and the HF conductor receiving element 10 is constant for a large number of terminal connections 1 which are established in series.

Figure 1B:
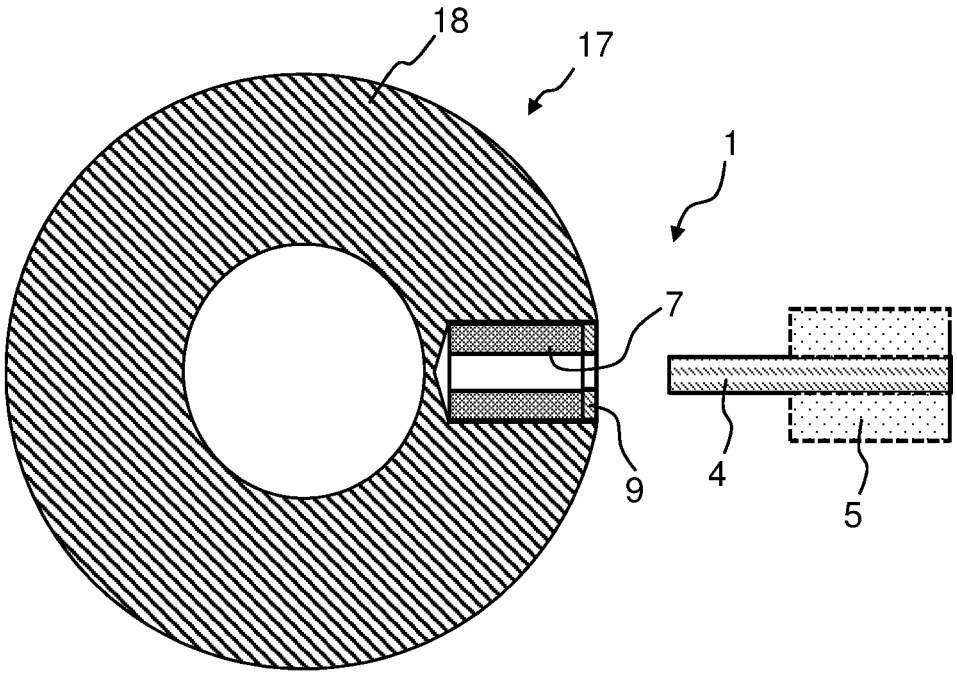
FIG. 1B is a simplified sectional view of the electrical device, which comprises an HF conductor receiving hole into which an insertion sleeve and a solder deposit have been inserted.

FIG. 1B is a simplified sectional view of the electrical device 17, which comprises an HF conductor receiving hole 15 into which the insertion sleeve 7 has already been inserted together with a solder deposit 9. Again, the solder deposit 9 is located on the end face of the insertion sleeve 7 positioned closest to the insertion opening 16, on the plug-in side, of the HF conductor receiving hole 15. After the end of the soldering process, the at least one solder deposit 9 preferably does not project beyond the HF conductor receiving hole 15, but instead ends flush at the end thereof. This is preferably also the case before the at least one solder deposit 9 is melted.

In the next step, the HF conductor can be inserted into the receiving opening 8 in the insertion sleeve 7 in a very simple manner. The arrangement of the at least one solder deposit 9 means that the HF conductor 4 has a single, radial contact with the HF conductor receiving element 10.

Figure 2:
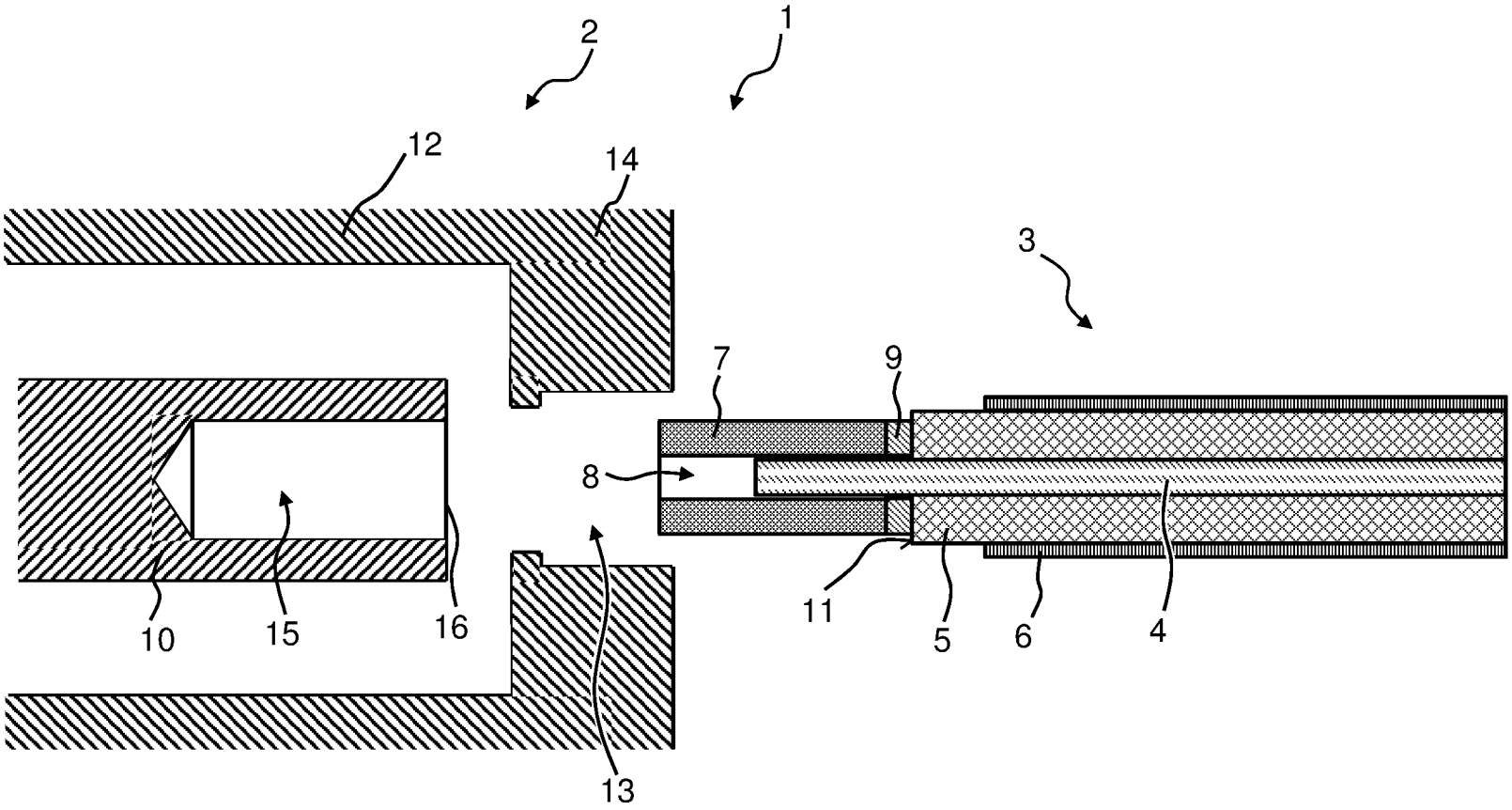
FIG. 2 is a simplified sectional view of a terminal device in the form of a plug-in connection.

FIG. 2 is a simplified sectional view of a terminal connection 1 in the form of a plug-in connection 1, the terminal apparatus 2 being in the form of a plug-in connector 2. The HF conductor 4 is enclosed by the dielectric 5 and the outer conductor 6 and thus forms an inner conductor of a coaxial cable 3. The HF conductor 4, in other words the inner conductor 4 of the coaxial cable 3, is exposed, meaning that the HF conductor 4 of the coaxial cable 3 projects beyond the dielectric 5 and the outer conductor 6 of the coaxial cable 3.

The terminal apparatus 1 in the form of the plug-in connection 1 further comprises the insertion sleeve 7. This insertion sleeve 7 includes the receiving opening 8, which has a diameter which preferably corresponds to or is slightly greater than the diameter of the HF conductor 4. The receiving opening 8 may fully pass through the insertion sleeve 7, as shown in FIG. 2. However, it may also be the case that the receiving opening 8 is in the form of a blind hole and has a base.

The terminal connection 1 likewise comprises at least one solder deposit 9, which is used for establishing an electrically conductive connection between the HF conductor 4 of the coaxial cable 3 and an HF conductor receiving element 10 of the terminal apparatus 2. In the embodiment of FIG. 2, the solder deposit 9 is in the form of a partially open or closed ring, which consists of a rigid or resilient material. In this case, the solder deposit 9 is placed on, in other words pushed onto, the HF conductor 4 of the coaxial cable 3, preferably far enough for the solder deposit 9 to touch an end face 11 of the dielectric 5. The insertion sleeve 7 is subsequently likewise placed onto the HF conductor 4 until it is in contact with the solder deposit 9. The solder deposit 9 is therefore arranged between the insertion sleeve 7 and the end face 11 of the dielectric 5 of the coaxial cable 3 which is to be or has been received.

If the HF conductor 4 does not comprise a dielectric 5 or an outer conductor 6, in other words is merely formed by a single wire or strand, the solder deposit 9 may for example be fixed to the HF conductor 4 by crimping. Slipping along the HF conductor 4 is thus no longer possible. The HF conductor 4 may also have small projections or indentations on which the at least one solder deposit is secured against slipping.

The insertion sleeve 7 is preferably a hollow cylinder. So as to achieve as low a heat capacity as possible, the insertion sleeve 7 is preferably made of a plastics material. The insertion sleeve 7 may for example be made by injection moulding. By contrast, the HF conductor receiving element 10 consists of a metal.

The terminal apparatus 2 in the form of a plug-in connector 2 further comprises an outer conductor socket 12, which is used for receiving the coaxial cable 3. For this purpose, the outer conductor socket 12 comprises a cable receiving opening 13. The outer conductor socket 12 is preferably formed from or coated with a conductive material, and has an outer conductor contacting portion 14 by which electrically conductive contact with the outer conductor 6 of the coaxial cable 3 to be received is established. The cable receiving opening 13 has a diameter which preferably corresponds to the diameter of the coaxial cable 3 as far as to the outer conductor 6 thereof. An external protective casing of the coaxial cable 3 is preferably stripped in the region of the cable receiving opening 13.

The HF conductor receiving element 10 has an HF conductor receiving hole 15. The HF conductor receiving hole 15 is used for receiving the HF conductor of the coaxial cable 3, the HF conductor receiving element 10 preferably being arranged in a centred manner within the outer conductor socket 12.

The diameter of the HF conductor receiving hole 15 is selected in such a way that it corresponds to or is somewhat larger than the external diameter of the insertion sleeve 7.

The insertion sleeve 7 can be inserted into the HF conductor receiving hole 15 in the HF conductor receiving element 10 via an insertion opening 16 on the plug-in side. The diameter of the HF conductor receiving hole 15 is preferably constant. It preferably does not change, in particular does not increase, over the axial length thereof.

Figure 3:
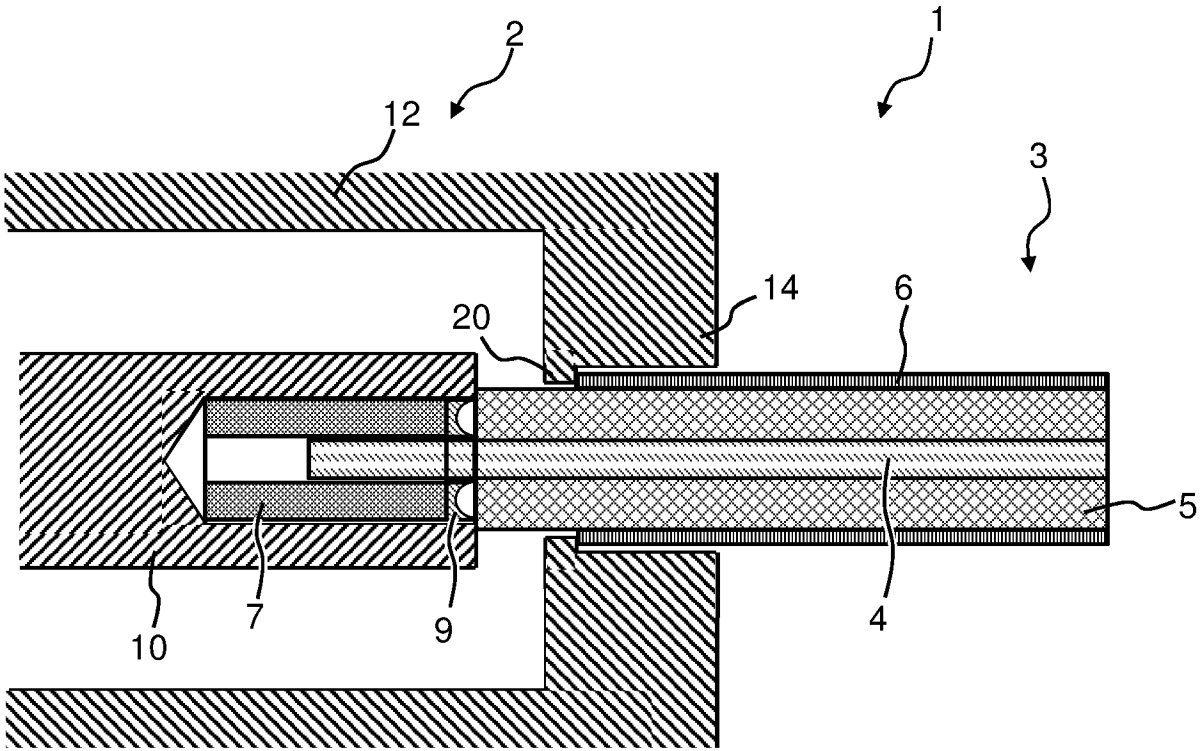
FIG. 3 is a simplified sectional view of the terminal connection according to the invention in the form of a plug-in connection.

FIG. 3 is a simplified sectional view of the terminal connection 1 according to the invention in the form of the plug-in connection 1, which has been produced by introducing the coaxial cable 3 into the HF conductor receiving element 10 of the terminal apparatus 2 together with the insertion sleeve 7 and the solder deposit 9. The insertion sleeve 7 is arranged within the HF conductor receiving hole 15, in other words within the HF conductor receiving element 10, in a manner limited by a stop. An end face of the HF conductor receiving element 10 projects beyond an end face of the insertion sleeve 7 to such an extent that the at least one solder deposit 9 is arranged on the end face of the insertion sleeve 7 and preferably ends flush with the end face of the HF conductor receiving element 10. However, the at least one solder deposit 9 may also project beyond the end face of the HF conductor receiving element 10. However, after the end of the soldering process, it should be positioned flush against the end face of the HF conductor receiving element 10, or not project therebeyond. In the embodiment of FIG. 3, part of the end face of the end face 11 of the dielectric 5 of the coaxial cable 3 which is to be or has been received is supported on the end face of the HF conductor receiving element 10.

The HF conductor 4 of the coaxial cable 3 only extends in the receiving opening 8 in the insertion sleeve 7 over part of the length of the receiving opening 8, in other words only over part of the length of the insertion sleeve 7. However, it would also be possible for the HF conductor 4 of the coaxial cable 3 to extend over the entire length of the receiving opening 8 or even a little beyond this.

In FIG. 3, the at least one solder deposit 9 has already been melted. The at least one solder deposit 9 may for example be heated using an induction loop. In this case, the HF conductor 4 of the received coaxial cable 3 is already electrically conductively connected to the HF conductor receiving element 10.

Subsequently, the outer conductor contacting portion 14 of the outer conductor socket 12 is additionally electrically conductively connection to the outer conductor 6 of the received coaxial cable 3. This may for example be achieved by pressing and/or by crimping. Preferably, the electrical contact between the outer conductor 6 and the outer conductor contacting portion 14 is separate from an additional, preferably purely mechanical fixing.

In this case, the outer conductor 6 of the coaxial cable 3 is positioned on a bearing shoulder 20. However, it is also possible for a further dielectric to be arranged between an end face of the outer conductor 6 of the coaxial cable 3 and the bearing shoulder 20 of the outer conductor socket 12 such that electrical contact between the end face of the outer conductor 6 of the coaxial cable 3 and the bearing shoulder 20 of the outer conductor socket 12 is prevented. Precisely this type of end-face contact presents difficulties as regards the reproducibility of the electrical contact. It is therefore advantageous if the outer conductor has a single electrical contact, having a radial component, with the outer conductor 6.

Figure 4A:
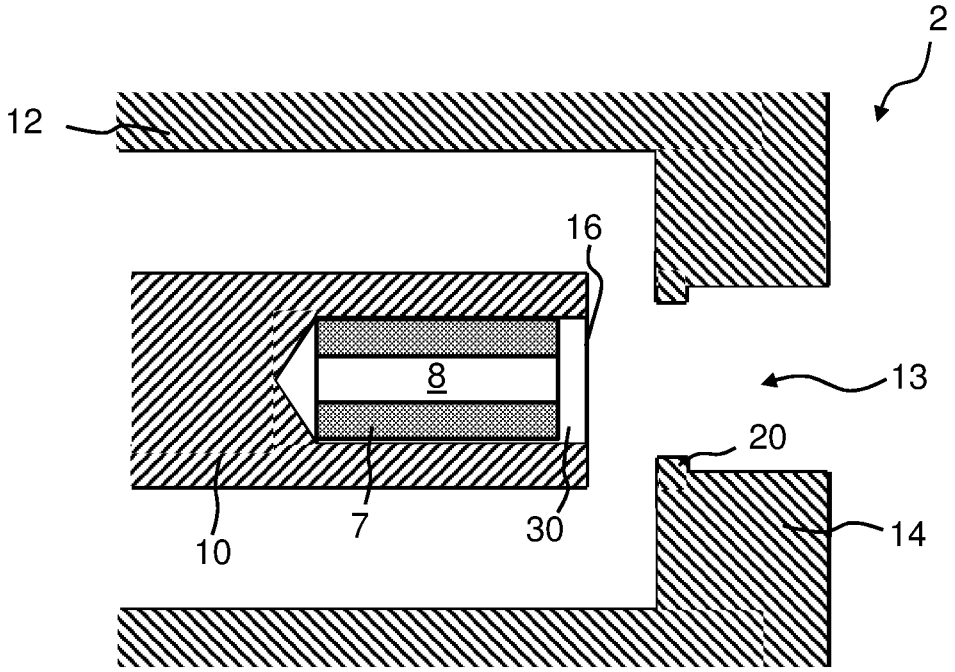
FIG. 4A is another simplified sectional view of an terminal apparatus in the form of a plug-in connector, into the HF conductor receiving element of which the insertion sleeve has already been inserted.
Figure 4B:
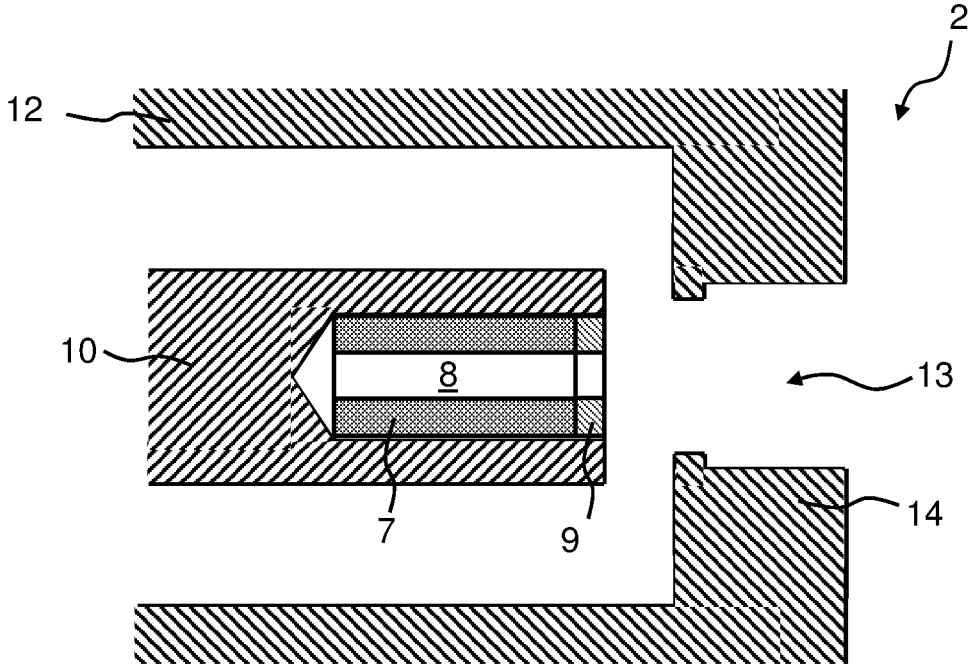
FIG. 4B is another simplified sectional drawing of an terminal apparatus in the form of a plug-in connector, into the HF conductor receiving element of which the insertion sleeve comprising the solder deposit has already been inserted.

FIG. 4A is another simplified sectional view of the terminal apparatus 2, into the HF conductor receiving element 10 of which the insertion sleeve 7 has already been inserted. By contrast with the embodiment of FIGS. 2 and 3, it is also possible for the insertion sleeve 7 not to be placed on the HF conductor 4 of the coaxial cable 3, but instead to be inserted directly into the HF conductor receiving hole 15 in the HF conductor receiving element 10 of the terminal apparatus 2. Also shown is the receiving opening 8 in the insertion sleeve 7, which is used for receiving the HF conductor 4 of the coaxial cable 3. After the insertion sleeve 7 is inserted into the HF conductor receiving hole 15 in the HF conductor receiving element 10 of the terminal apparatus 2, the at least one solder deposit 9, which is preferably an annular solder deposit 9, can subsequently be introduced into the space 30, remaining towards the insertion opening 16, in the HF conductor receiving hole 15. This situation is shown in FIG. 4B. Preferably, an end face of the at least one solder deposit 9 ends flush with the end face of the HF conductor receiving element 10. It is also possible for the end face of the HF conductor element 10 to project slightly beyond an end face of the at least one solder deposit 9 or conversely for the end face of the at least one solder deposit 9 to project beyond the end face of the HF conductor receiving element 10.

The HF conductor 4 of the coaxial cable 3 to be received may be passed through both the solder deposit 9 and the receiving opening 8 in the insertion sleeve 7.

Figure 5A:
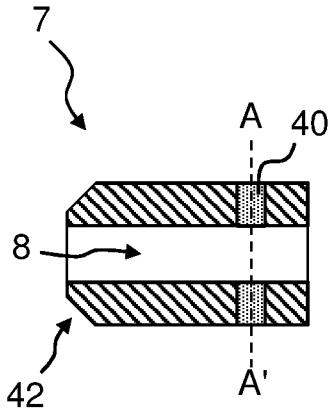
FIG. 5A is longitudinal section through the insertion sleeve, which comprises receiving channels into which the solder deposit has been introduced.

FIG. 5A is a longitudinal section through a further embodiment of the insertion sleeve 7. In an insertion sleeve 7 of this type, the solder deposit 9 is preferably not arranged between the insertion sleeve 7 and the end face 11 of the dielectric 5 of the coaxial cable 3 to be received, but instead in the insertion sleeve 7 itself. The insertion sleeve 7 comprises at least one receiving channel 40, which is in particular in the form of a hole. The receiving channel 40 extends preferably radially inwards from the outside into the receiving opening 8. The receiving channel 40 is used for receiving the at least one solder deposit 9. The receiving channel 40 may have a constant diameter. However, it may also be configured to be variable in diameter. For example, a longitudinal section through the receiving channel 40 may have a conical progression.

The solder deposit 9, which in this case preferably has a viscous consistency, is introduced into the at least one receiving channel 40. Subsequently, the insertion sleeve 7 can be placed on the HF conductor 4 of the coaxial cable 3 and, together therewith, inserted directly into the HF conductor receiving hole 15. It is also possible for the at least one receiving channel 40 to only be filled with the solder deposit 9 once the insertion sleeve 7 is placed on the HF conductor 4 of the coaxial cable. In this case, it is ensured that only unaged solder is used for producing the solder deposit 9.

Preferably, the solder deposit 9 can likewise be introduced into the insertion sleeve 7 at the half-length thereof. If there are a plurality of solder deposits 9, they are preferably arranged symmetrically about an imaginary straight line extending transversely through the longitudinal section through the centre of the insertion sleeve 7. This ensures that the solder deposits 9 always contact the HF conductor 4 with the HF conductor receiving element 10 at the same point, specifically regardless of the direction in which the insertion sleeve 7 is inserted into the HF conductor receiving hole 15.

The insertion sleeve 7 of FIG. 5A likewise has a bevelled portion 42 in longitudinal section. This portion 42 makes it easier to insert the insertion sleeve 7 into the HF conductor receiving hole 15. The insertion sleeve 7 is therefore preferably conical in longitudinal section at the insertion end thereof. However, the bevelling may also extend parabolically in longitudinal section. The insertion sleeve 7 may also have bevelling 42 of this type at both ends. In this case, it does not matter in which direction the insertion sleeve 7 is placed on the HF conductor 4 or inserted into the HF conductor receiving sleeve 15.

Figure 5B:
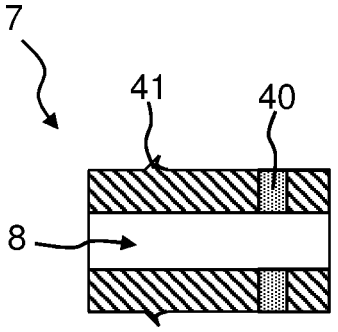
FIG. 5B is a longitudinal section through a further embodiment of the insertion sleeve, which comprises barbs so that it can no longer fall out of the HF conductor element.

FIG. 5B shows a longitudinal section through a further embodiment of the insertion sleeve 7, which comprises barbs 41 so that the insertion sleeve 7 can no longer fall out of the HF conductor receiving hole 15 when inserted therein. In this embodiment, the insertion sleeve 7 comprises, on the circumference thereof, at least one portion 41 which projects into the HF conductor receiving element 10 counter to the insertion direction and which may be referred to as a barb 41. This projecting portion 41 may also lead radially around the circumference of the insertion sleeve 7, in other words extend over the circumference without interruption. The projecting portion 41 is preferably resilient so that it adapts to the circumference of the insertion sleeve 7 when inserted into the HF conductor receiving hole 15, and only engages in a corresponding groove or slot if the insertion sleeve 7 has reached the desired position within the HF conductor receiving hole 15.

It is also possible for the insertion sleeve 7 to comprise at least one coding element on the circumference thereof, meaning that the insertion sleeve 7 can only be inserted into the HF conductor receiving element 10, in other words into the HF conductor receiving hole 15, in a particular position, and is mounted therein in a twist-proof manner and preferably in a manner limited by a stop.

Figure 5C:
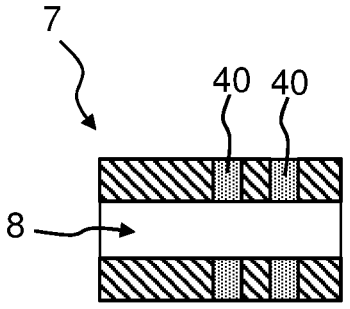
FIG. 5C is a longitudinal section through a further embodiment of the insertion sleeve, which comprises various receiving channels that are spaced apart in the longitudinal direction within the insertion sleeve.

FIG. 5C is a longitudinal section through a further embodiment of the insertion sleeve 7, which comprises various receiving channels 40 which are spaced apart in the longitudinal direction within the insertion sleeve 7. If the longitudinal direction is the Z axis, this means that the individual receiving channels 40 have the same dimensions and the same position with respect to an imaginary X-Y coordinate system, but differ in position along the Z axis. In this case, the individual receiving channels 40 would be arranged "congruently" above one another. However, it is also conceivable for the individual receiving channels 40 to be arranged in an offset manner above one another. In terms of position along the Z axis, said channels would thus also differ with respect to the X and/or Y axis. This means that the at least two receiving channels 40 are spaced apart in the longitudinal direction and, in a plan view, are arranged congruently, congruent in part or fully offset above one another.

In FIG. 5A to 5C, the receiving channels 40 have already been filled with a solder deposit 9.

Figure 5D:
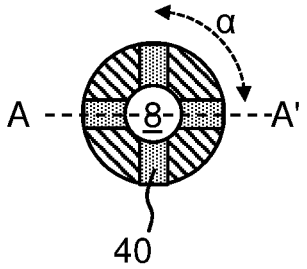
FIG. 5D is a cross section through the insertion sleeve, which comprises four receiving channels for each receiving the solder deposit, which is arranged symmetrically.

FIG. 5D is a cross section through the insertion sleeve 7, which comprises four receiving channels 40 for each receiving a solder deposit 9. The receiving channels 40 are preferably in the form of holes, which in the embodiment of FIG. 5D extend radially inwards from the outside into the receiving opening 8. The insertion sleeve 7 preferably comprises X receiving channels 40, X preferably being ≥2. In a plan view of the cross section through the insertion sleeve 7, the receiving channels 40 are arranged so as to be spaced apart by $\alpha=360°/X$. In the embodiment of FIG. 5D, there are four receiving channels 40. This means that each receiving channel 40 is arranged to be offset from another receiving channel by $\alpha=90°$.

Figure 5E:
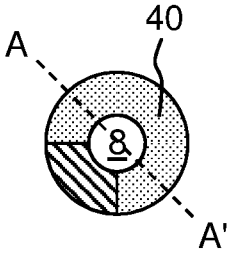
FIG. 5E is a cross section through the insertion sleeve, the receiving channel being in the form of a cut-out which extends over a range of 270° and into which the solder deposit, preferably in the form of an open ring, can be inserted.

FIG. 5E is a cross section through the insertion sleeve 7, the receiving channel 40 being in the form of a cut-out. In a plan view of the cross section through the insertion sleeve 7, this cut-out has a range of more than 180°, preferably more than 220°, more preferably more than 260°, more preferably more than 300°, more preferably more than 340°, but less than 350°. In the embodiment of FIG. 5E, the cut-out covers a range of 270°. In this case, the solder deposit 9 is preferably in the form of an open ring, which can be "clipped" into or "laid" in the cut-out. The thickness of the cut-out approximately corresponds to the diameter of the receiving channels 40 of FIG. 5A to 5D. The diameter of each receiving channel 40 may be greater than the length of the corresponding receiving channel 40. However, it is also possible for the length of a receiving channel 40 to be greater than the diameter of the receiving channel.

Figure 6:
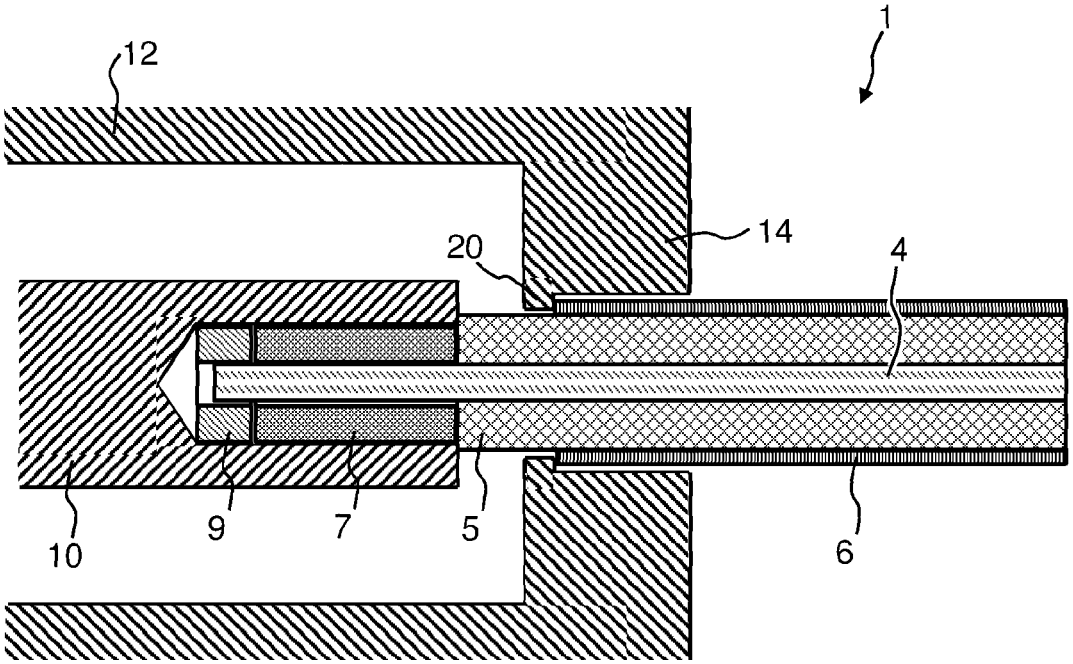
FIG. 6 is a simplified sectional view of a further embodiment of the terminal connection according to the invention in the form of a plug-in connection, the insertion sleeve being arranged between the solder deposit and the dielectric of a coaxial cable.

FIG. 6 is a simplified sectional view of a further embodiment of the terminal connection 1 according to the invention in the form of a plug-in connector 1, the insertion sleeve 7 being arranged between the solder deposit 9 and the dielectric 5 of the coaxial cable 3. In this case, the solder deposit 9 is inserted into the HF conductor receiving hole 15 in the HF conductor receiving element 10 before the insertion sleeve 7. During assembly, the insertion sleeve 7 and, either subsequently or simultaneously, the solder deposit 9 are placed on the HF conductor 4 of the coaxial cable 3. It is also possible for the HF conductor 4 to extend through the solder deposit 9 and end therein. In this case, the end face of the HF conductor 4 does not touch the HF conductor receiving element 10. By contrast with the preceding embodiments, which exhibit predominantly radial contact, electrical contact between the HF conductor 4 and the HF conductor receiving element 10 also takes place at the end face.

In FIG. 6, the dielectric 5 of the coaxial cable 3 is positioned on an end face of the HF conductor receiving element 10. The end face of the outer conductor 6 abuts the bearing shoulder 20 of the outer conductor socket 12.

Figure 7:
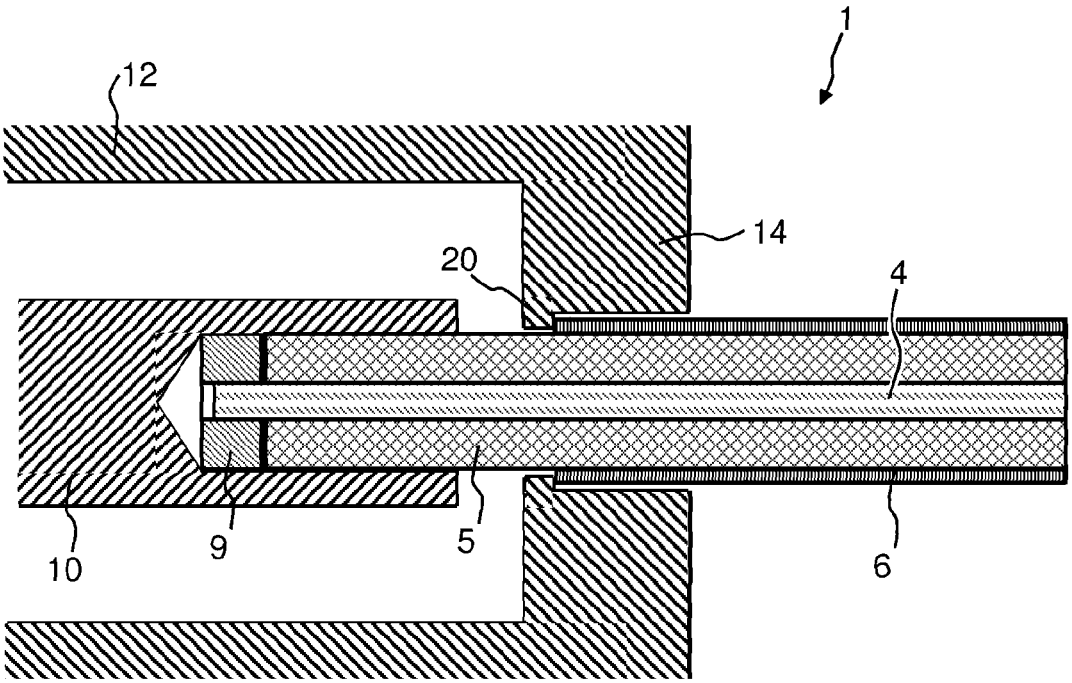
FIG. 7 is a simplified sectional view of another embodiment of the terminal connection according to the invention in the form of a plug-in connection, in which, instead of an insertion sleeve, the dielectric is inserted directly into the HF conductor receiving hole together with the projecting HF conductor.

FIG. 7 is a simplified sectional view of another embodiment of the terminal connection 1 according to the invention in the form of a plug-in connection 1. No insertion sleeve 7 is used. The dielectric 5 of the coaxial cable 3 is inserted directly into the HF conductor receiving hole 15 together with the projecting HF conductor 4. The solder deposit 9 can initially be inserted into the HF conductor receiving hole 15, the HF conductor 4 and the dielectric 5 of the coaxial cable 3 to be received being inserted into the HF conductor receiving hole 15. It is also possible to place the solder deposit 9 on the HF conductor 4, the two subsequently both being inserted into the HF conductor receiving hole 15.

The solder deposit 9 is preferably in the form of a partially open or closed ring. The external diameter of the preferably annular solder deposit 9 is preferably the same size as the external diameter of the dielectric 5. It may also be possible for the part of the dielectric 5 inserted into the HF conductor receiving hole 15 to have a smaller diameter than the part of the dielectric 5 still enclosed by the outer conductor 6.

The embodiments of FIGS. 6 and 7 make it possible to solder the HF conductor 4 at the end face thereof without mechanical loads leading to damage thereto.

Figure 8A:
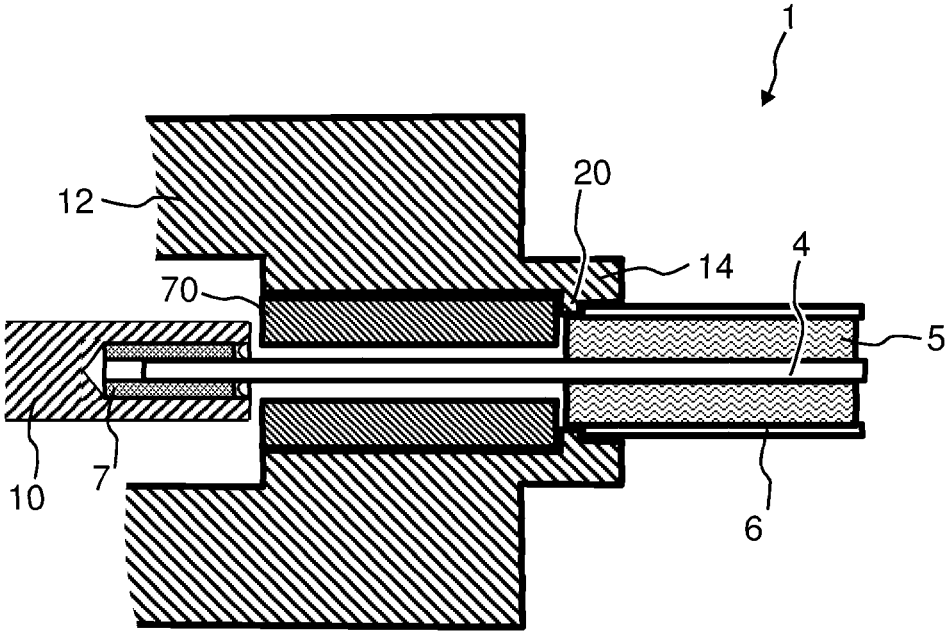
FIG. 8A is a simplified sectional view of a further embodiment of the terminal connection according to the invention in the form of a plug-in connection, an adapter element being arranged within the plug-in connector to adjust the surge impedance of the coaxial cable.

FIG. 8A is a simplified sectional drawing of a further embodiment of the terminal connection 1 according to the invention in the form of a plug-in connection 1, at least one adapter element 70 being arranged within the terminal device 2 so as to adjust the surge resistance of the coaxial cable 3. Because of the reproducibility of the HF conductor soldering, by use of the insertion sleeve 7 among other things, long connectors can also be manufactured cost-effectively. The HF conductor 4 of a plug-in connection 1 of this type consists of beryllium copper. Because of the great length of the terminal apparatus 2 in the form of a plug-in connector 2, there is a large distance between the electrical contacting of the HF conductor 4 with the HF conductor receiving element 10 and the outer conductor contacting portion 14, at which the outer conductor is electrically conductively connected to the outer conductor socket 12. This can result in problems during adaptation (VSWR; voltage standing wave ratio). This is compensated for by a suitable dielectric, in the form of the adapter element 70.

The at least one adapter element 70 is arranged between the outer conductor contacting portion 14 and the HF conductor receiving element 10. It is preferably in the form of a hollow cylinder, the HF conductor 4 of the coaxial cable 3 being passed therethrough. The adapter element 70 encloses the HF conductor 4, preferably radially. However, it is also possible for the at least one adapter element 70 to not enclose the HF conductor 4 over the entire circumference thereof, in other words in a 360° range, but only over a particular portion.

Figure 8B:
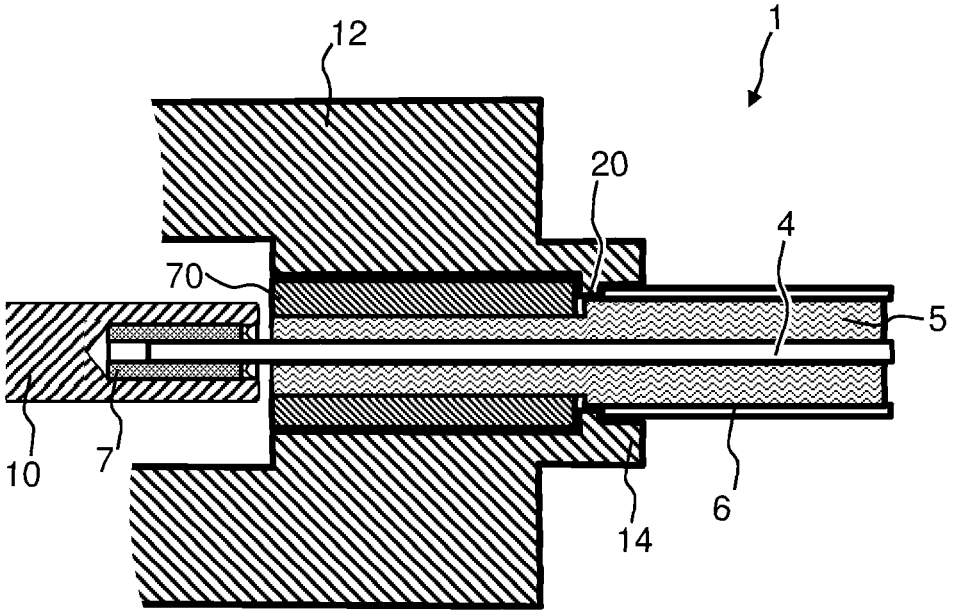
FIG. 8B is a simplified sectional view of a further embodiment of the terminal connection according to the invention in the form of a plug-in connection comprising an adapter element to adjust the surge impedance of the coaxial cable.

FIG. 8B is a simplified sectional view of a further embodiment of the terminal connection 1 according to the invention in the form of a plug-in connection 1, the at least one adapter element 70 being arranged within the terminal apparatus 2, which is in the form of a plug-in connector 2, so as to adjust the surge impedance of the coaxial cable 3. By contrast with the embodiment of FIG. 8A, the adapter element 70 also encloses the dielectric 5 of the coaxial cable 3. The external radius of the dielectric 5 varies within FIG. 8B. The region of the dielectric 5 that is enclosed by the adapter element 70 has a smaller external diameter than the region of the dielectric 5 which the outer conductor 6 abuts. The external diameter of the dielectric 5 preferably changes in the region of the bearing shoulder 20.

The adapter element 70 may for example be inserted before the terminal apparatus 2 is assembled or alternatively be inserted via the cable receiving opening 13. In the latter case, however, the outer conductor socket 12 does not have a bearing shoulder 20.

Figure 9A:
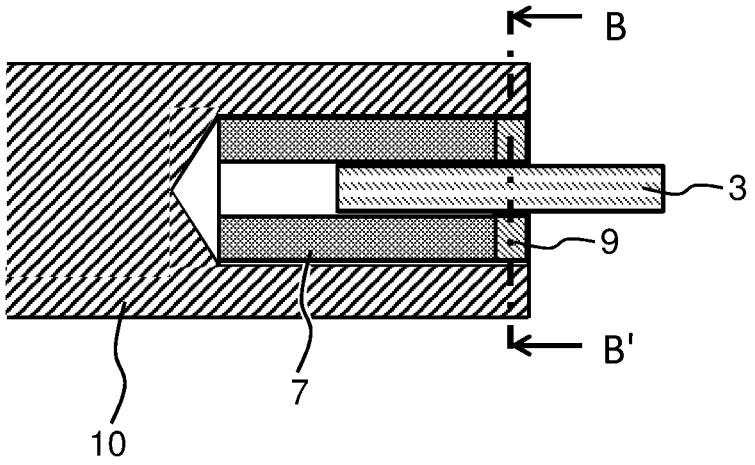
FIG. 9A, 9B are simplified sectional views of a further embodiment of the terminal connection according to the invention in the form of an electrical device, the cross section of the HF conductor being angular.
Figure 9B:
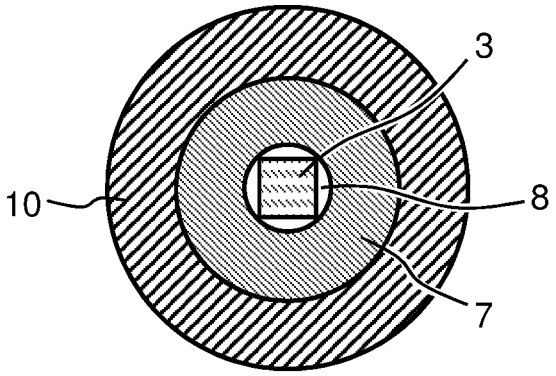

FIGS. 9A and 9B are simplified sectional views of a further embodiment of the terminal connection 1 according to the invention in the form of an electrical device 17, the cross section of the HF conductor 4 being angular. FIG. 9B is a cross section along the line B-B' of FIG. 9A. The HF conductor 4 which is to be or has been received may have a cross section which, in a plan view, corresponds to or is approximately a square, a rectangle, an oval, a circle, or a regular or irregular n-gon. The cross section of the receiving opening 8 in the insertion sleeve 7 is preferably adapted to the cross section of the HF conductor 4. This prevents the HF conductor 4 from rotating in the insertion sleeve 7, meaning that the solder connection is not damaged.

Figure 10A:
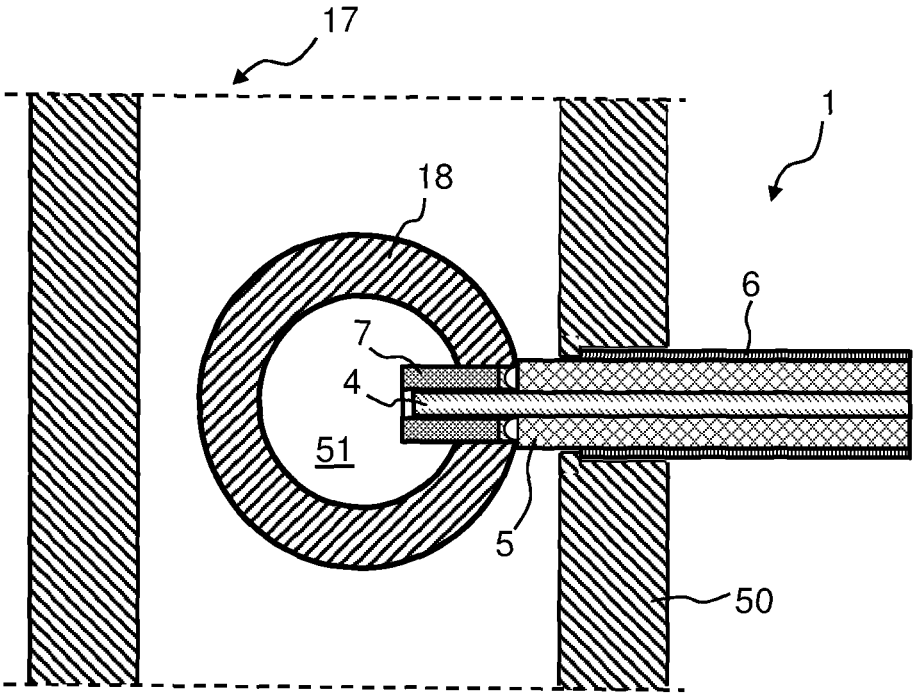
FIG. 10A, 10B are simplified sectional drawings of the electrical device in which the terminal connection according to the invention is used for receiving and contacting the HF conductor, the HF conductor being enclosed in part by a dielectric and an outer conductor and thus forming the inner conductor of a coaxial cable.

FIG. 10A is a simplified sectional view of the electrical device 17 in which the terminal connection 1 according to the invention is used for receiving and contacting the HF conductor 4, the HF conductor 4 being enclosed in part by a dielectric 5 and an outer conductor 6 and thus forming the inner conductor 4 of the coaxial cable 3. The electrical device 17 is for example an HF filter. As in FIGS. 1A and 1B, the HF filter has a resonator inner conductor 18. FIG. 10A further shows a housing wall 50. The resonator inner conductor 18 has a circular clearance 51, which preferably extends in the direction of a housing cover (not shown). By contrast with that of FIGS. 1A and 1B, the HF conductor receiving hole 15 is not configured as a blind hole, but instead passes completely through a lateral wall of the resonator inner conductor 18 and opens into the clearance 51. The insertion sleeve 7 therefore projects through the wall of the resonator inner conductor 18 into the clearance 51. Therefore, only part of the lateral circumferential face of the insertion sleeve 7 is supported against the inner wall of the HF conductor receiving hole 15.

Furthermore, the HF conductor 4 is enclosed by a dielectric 5 and an outer conductor 6. The HF conductor 4 and the dielectric 5 project through the housing wall 50 into the HF filter. The outer conductor 6 ends in the middle of the housing wall 50, and at least an end face of said conductor is in electrical contact with said wall. It is also possible for the outer conductor 6 to additionally be in electrical contact with the housing wall 50 by a part of its lateral circumferential wall. The end face of the dielectric 5 abuts the solder deposit 9.

Figure 10B:
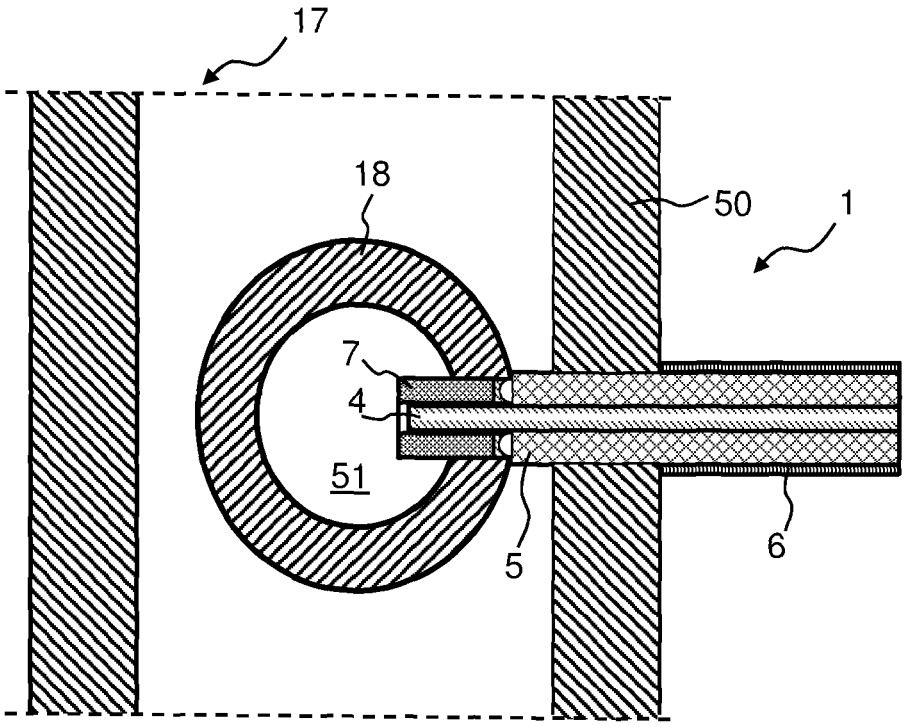

FIG. 10B, like FIG. 10A, is a simplified sectional view of the electrical device 17. By contrast with FIG. 10A, the outer conductor 6 of the coaxial cable 3 does not end within the housing wall 50. Therefore, only the HF conductor 4 and the dielectric 5 are guided through the hole extending through the housing wall 50. The end face of the outer conductor 6 abuts the outer face of the housing wall 50. The hole through the housing wall 50 has a diameter corresponding to or slightly greater than the external diameter of the dielectric 5. However, the diameter is slightly smaller than the diameter of the outer conductor 6.

Figure 11A:
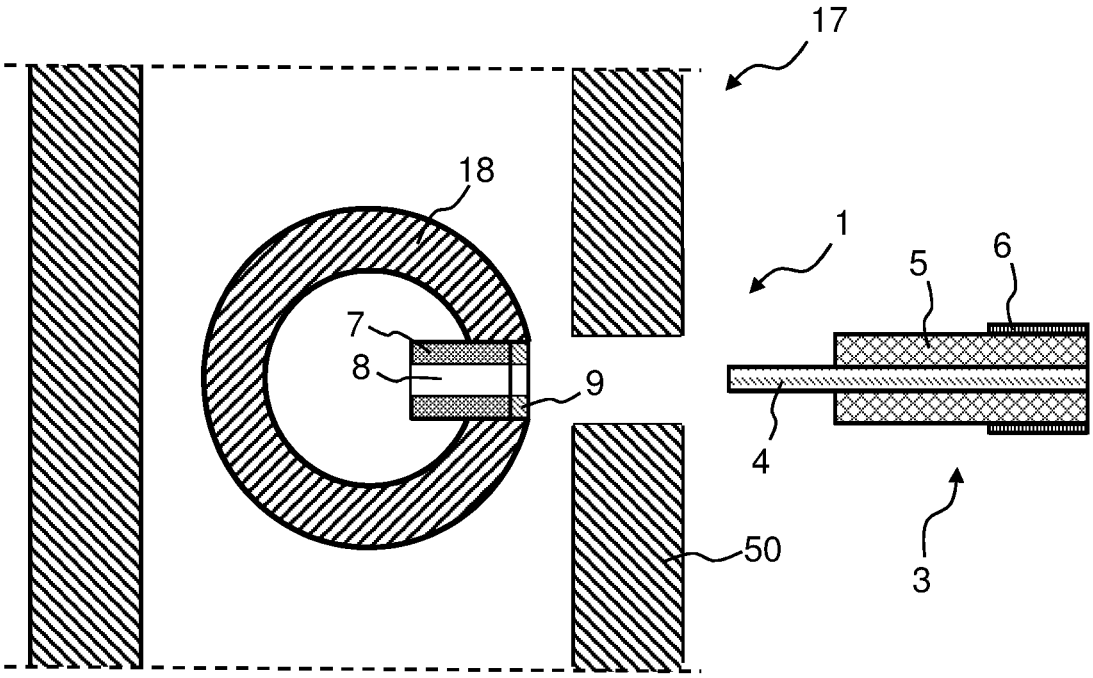
FIG. 11A, 11B are simplified sectional drawings of the electrical device in which the terminal connection according to the invention is used for receiving and contacting the HF conductor, the HF conductor being enclosed in part by a dielectric and an outer conductor and thus forming the inner conductor of a coaxial cable.
Figure 11B:
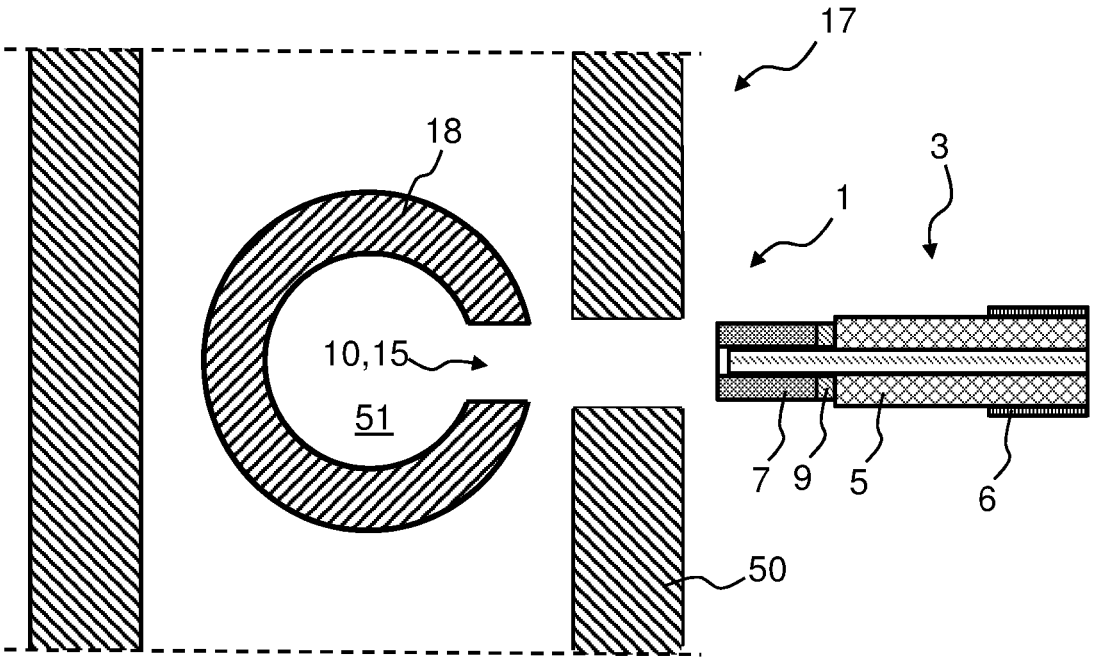

FIGS. 11A and 11B are simplified sectional views of the electrical device 17 in which the terminal connection 1 is used for receiving and contacting the HF conductor 4, the HF conductor 4 being enclosed in part by a dielectric 5 and an outer conductor 6 and thus forming the inner conductor 4 of a coaxial cable 3. The HF conductor 4 projects beyond the dielectric 5 enclosing it. The dielectric 5 likewise projects beyond the outer conductor 6 enclosing it. In the embodiment of FIG. 11A, the insertion sleeve 7 has already been inserted into the HF conductor receiving hole 15 in the HF conductor receiving element 10 together with the solder deposit 9.

By contrast with the embodiment of FIG. 11A, in the embodiment of FIG. 11B the insertion sleeve 7 has been placed on the HF conductor 4 of the coaxial cable 3 together with the at least one solder deposit 9. The coaxial cable 3 is therefore inserted through the opening in the housing wall 50 into the HF conductor receiving hole 15 in the HF conductor receiving element 10 at least in part together with the insertion sleeve 7 and the at least one solder deposit 9.

Figure 12:
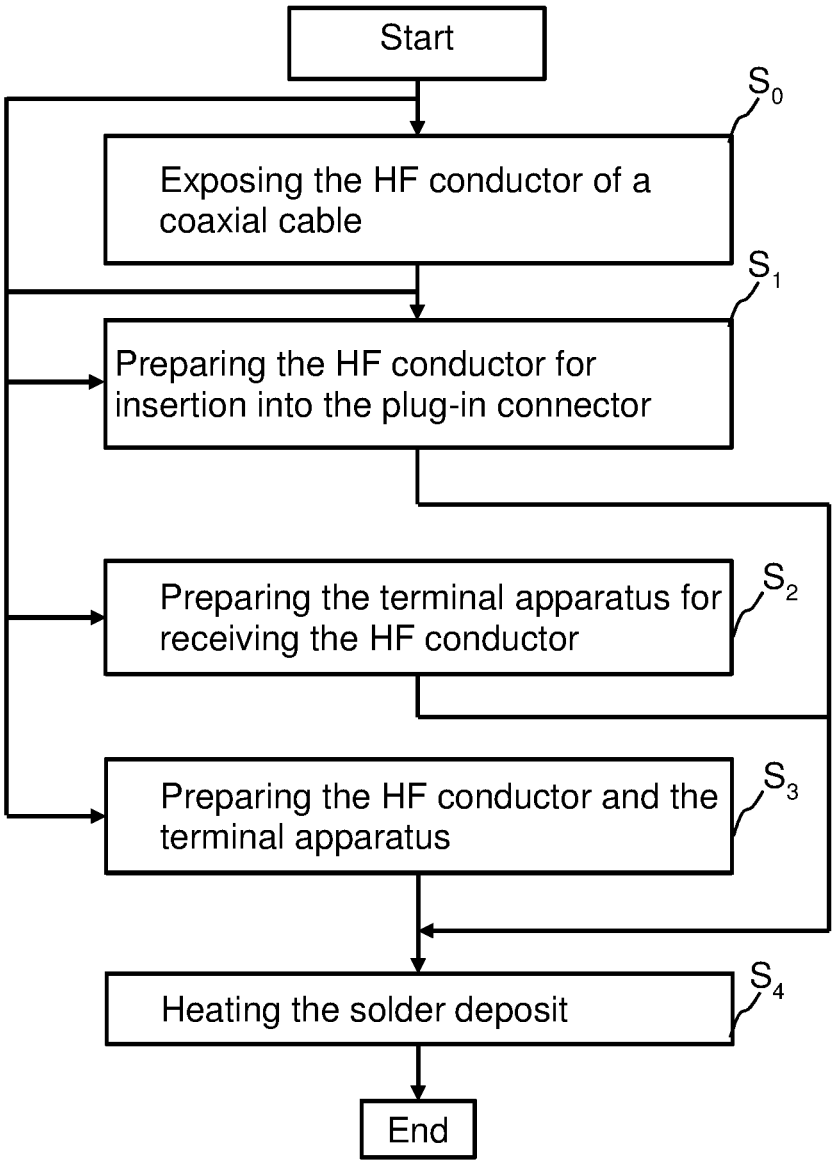
FIG. 12 is a flow chart describing the production of the plug-in connection according to the invention.

FIG. 12 is a flow chart illustrating the production of the terminal connection 1 according to the invention in the form of a plug-in connector 1 in greater detail.

In the first method step $S_1$, the HF conductor 4 to be received has to be prepared appropriately. This can be achieved by way of various steps. For example, it is possible to place a preferably annular solder deposit 9 and the insertion sleeve 7 on the HF conductor 4 either in succession or simultaneously. The preferably annular solder deposit 9 is thus located between the end face of the insertion sleeve 7 and the end face 11 of the dielectric 5 of the coaxial cable 3. By contrast, the insertion sleeve 7 and the preferably annular solder deposit 9 may also be placed on the HF conductor 4 either in succession or simultaneously.

The solder deposit 9 is therefore arranged at the end of the HF conductor 4. The HF conductor 4 extends through the insertion sleeve 7 and ends within the solder deposit 9. It is also possible for the insertion sleeve 7 to be placed on the HF conductor 4, the at least one solder deposit 9 already being arranged on or in the insertion sleeve 7. In this case, the insertion sleeve 7 could for example comprise receiving channels 40. Furthermore, it would also be possible for the insertion sleeve 7 to be placed on the HF conductor 4 and for at least one solder deposit 9 to subsequently be arranged in the insertion sleeve 7. Then, the HF conductor 4 to be received can be inserted into the HF conductor receiving element 10, in other words into the HF conductor receiving hole 15 in the terminal apparatus 2, together with the insertion sleeve 7 and the at least one solder deposit 9.

As an alternative to method step $S_1$, method step $S_2$ could also be carried out. In method step $S_2$, the terminal apparatus 2 is instead prepared appropriately. This is achieved for example by the at least one solder deposit 9 being arranged in the insertion sleeve 7 and by the insertion sleeve 7 that has the at least one solder deposit 9 being subsequently inserted into the HF conductor receiving hole 15 in the HF conductor receiving element 10 of the terminal apparatus 2. It would also be possible for the insertion sleeve 7 to be inserted into the HF conductor receiving hole 15 in the HF conductor receiving element 10 of the terminal apparatus 2 and subsequently for a preferably annular solder deposit 9 to be inserted into the space 30, remaining towards the HF conductor receiving hole 15, in the HF conductor receiving hole 15 in the HF conductor receiving element 10 of the terminal apparatus 2. It would also be possible for the preferably annular solder deposit 9 to be inserted into the HF conductor receiving hole 15 in the HF conductor receiving element 10 of the terminal apparatus 2 and furthermore for the insertion sleeve 7 to be inserted or introduced into the HF conductor receiving hole 15 in the HF conductor receiving element 10 of the terminal apparatus 2. Further, the HF conductor 4 of the coaxial cable 3 to be received would have to be inserted into the receiving opening 8 in the insertion sleeve 7 or into the receiving opening 8 in the insertion sleeve 7 and into the annular solder deposit 9.

As an alternative to method steps $S_1$ and $S_2$, method step $S_3$ could also be carried out. In method step $S_3$, both the HF conductor 4 and the terminal apparatus 2 are prepared. The insertion sleeve 7 is inserted into the HF conductor receiving hole 15 in the HF conductor receiving element 10 of the terminal apparatus 2, and simultaneously or alternately the preferably annular solder deposit 9 is placed on the HF conductor 4. Further, the HF conductor 4 is inserted into the receiving opening 8 in the insertion sleeve 7.

Subsequently, in other words after one of method steps $S_1$, $S_2$ and $S_3$, method step $S_4$ is carried out. In method step $S_4$, the solder deposit 9 is heated until it is melted into a liquid and thus electrically conductively connects the HF conductor 4 to the HF conductor receiving element 10. In method step $S_4$, an induction loop may be used which causes the solder deposit 9 to melt.

If the HF conductor 4 is also enclosed by a dielectric and optionally also by an outer conductor 6, in other words forms the inner conductor 4 of a coaxial cable, method step $S_0$ must also be carried out for the first or second or third method step $S_1$, $S_2$ or $S_3$. In this method step $S_0$, the HF conductor 4 of the coaxial cable 3 to be received is exposed. This is best achieved using appropriate stripping tools. The HF conductor therefore projects beyond the dielectric 5 and the optional outer conductor 6.

In a further method step, the outer conductor contacting portion 14 of the outer conductor socket 12 can be pressed together with and/or crimped to the outer conductor 6 of the received coaxial cable 3 such that electrical contact between the outer conductor 6 of the coaxial cable 3 and the outer conductor socket 12 is also established.

The wording whereby a solder deposit is inserted "into" the insertion sleeve means that the insertion sleeve 7 comprises at least one receiving channel 40 or the like in which the solder deposit 9 is arranged.

The invention is not limited to the described embodiments. All features disclosed and/or shown can be combined with one another in any desired manner within the scope of the invention.

The invention claimed is:

1. A terminal connection comprising a high frequency conductor (HF) and a terminal apparatus comprising:

an HF conductor receiving element comprising an HF conductor receiving hole for receiving the HF conductor;

at least one solder deposit for establishing an electrically conductive contact between the HF conductor and the HF conductor receiving element of the terminal apparatus;

an insertion sleeve comprising a receiving opening into which the HF conductor is inserted, the HF conductor inserted into the insertion sleeve and being soldered by the at least one solder deposit to the HF conductor receiving element;

the insertion sleeve being inserted into the HF conductor receiving hole in the HF conductor receiving element via an insertion opening on a plug-in side;

wherein the at least one solder deposit is:

a) arranged in the insertion sleeve; and/or b) arranged on at least one end face of the insertion sleeve; and/or c) arranged on the HF conductor; and the insertion sleeve i. is undeformable; and/or ii. consists of a dielectric; and/or iii. is adapted, in terms of a circumferential lateral face thereof, to an inner face of the HF conductor receiving hole, is supported against the inner face of the HF conductor receiving hole, and is only displaceable in a longitudinal direction within the HF conductor receiving hole; and/or iv comprises at least one receiving channel, which extends inwards from the outside into the receiving opening, the at least one receiving channel being used for receiving the at least one solder deposit.

2. The terminal connection according to claim 1, wherein:

the at least one solder deposit:

a) consists of a rigid or resilient material and is in the form of a partially open or closed ring; or b) consists of a viscous material.

3. The terminal connection according to claim 1, wherein:

the HF conductor extends in the receiving opening in the insertion sleeve over an entire length or over part of the length of the receiving opening; and/or the HF conductor has a cross section which, in a plan view, corresponds to or is approximately:

a square; or a rectangle; or an oval; or a circle; or a regular or irregular n-gon.

4. The terminal connection according to claim 1, wherein:

the insertion sleeve is arranged within the HF conductor receiving element in a manner limited by a stop; and/or the at least one end face of the insertion sleeve is positioned in the same plane as an end face of the HF conductor receiving element, or the HF conductor receiving element has an end face that projects beyond the at least one end face of the insertion sleeve in such a way that the at least one solder deposit is arranged in a space, remaining towards the insertion opening, in the HF conductor receiving hole in the HF conductor receiving element of the terminal apparatus, and, after a melting process thereof, the at least one solder deposit becomes flush with the end face of the HF conductor receiving element.

5. The terminal connection according to claim 1, wherein:

in the case where the insertion sleeve comprises the at least one receiving channel, the at least one receiving channel comprises at least two receiving channels which extend inwards from the outside into the receiving opening, the at least two receiving channels being used for receiving the at least one solder deposit, the at least two receiving channels being spaced apart in the longitudinal direction through the insertion sleeve and, in a plan view, being arranged congruently, congruently in part or so as to be fully offset above one another.

6. The terminal connection according to claim 1, wherein:

in the case where the insertion sleeve comprises the at least one receiving channel, the at least one receiving channel comprises X receiving channels which extend inwards from the outside into the receiving opening, the receiving channels being used for receiving the at least one solder deposit, X being ≥2, said X receiving channels being arranged so as to be spaced apart by $\alpha=360°/X$ in a plan view of a cross section through the insertion sleeve.

7. The terminal connection according to claim 1, wherein:

the at least one receiving channel is in the form of a cut-out which, in a plan view of the cross section through the insertion sleeve, has a range of more than 180°; and the at least one solder deposit is arranged in the cut-out.

8. The terminal connection according to claim 1, wherein:

the at least one solder deposit is arranged in the at least one receiving channel of the insertion sleeve.

9. The terminal connection according to claim 1, wherein:

the insertion sleeve comprises at least one coding element on a circumference thereof, whereby the insertion sleeve can only be inserted into the HF conductor receiving element in a particular position in a twist-proof manner; and/or the insertion sleeve comprises a bevel in a longitudinal section at an insertion end thereof; and/or the insertion sleeve comprises at least one projecting portion on the circumference thereof, the at least one projecting portion projecting into the HF conductor receiving element counter to an insertion direction, preventing the insertion sleeve upon insertion from sliding out of the HF conductor receiving element.

10. The terminal connection according to claim 1, wherein:

the HF conductor is enclosed over at least part of a length thereof by a solid dielectric; or the HF conductor is enclosed over at least part of the length thereof by a solid dielectric which is enclosed over at least part of the length thereof by an outer conductor such that the HF conductor forms an inner conductor of a coaxial cable which is to be or has been received.

11. The terminal connection according to claim 10, wherein:

a part of an end face of the dielectric of the received coaxial cable is supported on an end face of the HF conductor receiving element; or the dielectric of the received coaxial cable is inserted into the HF conductor receiving hole of the HF conductor receiving element at least in part.

12. The terminal connection according to claim 10, wherein:

the terminal apparatus is a plug-in connector;

the plug-in connector comprising an outer conductor socket for receiving the coaxial cable;

the outer conductor socket comprises an outer conductor contacting portion, at which the outer conductor of the received coaxial cable is electrically contacted with the outer conductor socket of the plug-in connector;

at least one adapter element is arranged between the outer conductor contacting portion and the HF conductor receiving element; and the at least one adapter element is arranged radially around the HF conductor or around the HF conductor and the dielectric of the received coaxial cable at least in part.

13. Method for producing the terminal connection according to claim 10, wherein the HF conductor is enclosed over at least part of the length thereof by the solid dielectric, the solid dielectric being enclosed over at least part of its length or over its entire length by the outer conductor such that the HF conductor forms the inner conductor of a coaxial cable, the method comprising:

A0) exposing the HF conductor of the coaxial cable; and a) inserting, at least in part, the coaxial cable dielectric to be received into the HF conductor receiving hole.

14. Method for producing a plug-in connection according to claim 13, wherein:

the terminal apparatus is a plug-in connector;

the plug-in connector comprises an outer conductor socket for receiving the coaxial cable;

an outer conductor socket comprises the outer conductor contacting portion, and the following method step being carried out:

a) pressing and/or crimping the outer conductor contacting portion of the outer conductor socket to the outer conductor of the received coaxial cable such that electrical contact between the outer conductor of the coaxial cable and the outer conductor socket is established.

15. Method for producing the terminal connection according to claim 1, comprising the following:

A1) preparing the HF conductor to be received by:

a) placing the at least one solder deposit and the insertion sleeve on the HF conductor; or b) placing the insertion sleeve and the at least one solder deposit on the HF conductor; or c) placing the insertion sleeve on the HF conductor, the at least one solder deposit already being arranged in the insertion sleeve; or d) placing the insertion sleeve on the HF conductor and arranging the at least one solder deposit in the insertion sleeve; and inserting the HF conductor into the HF conductor receiving element of the terminal apparatus together with the insertion sleeve and the at least one solder deposit; or A2) preparing the terminal apparatus by:

a) arranging the at least one solder deposit in the insertion sleeve and inserting the insertion sleeve into the HF conductor receiving hole together with the at least one solder deposit; or b) inserting the insertion sleeve into the HF conductor receiving hole and inserting or introducing the at least one solder deposit into a space remaining towards the insertion opening in the HF conductor receiving hole; or c) inserting the at least one solder deposit into the HF conductor receiving hole, and furthermore inserting or introducing the insertion sleeve into the HF conductor receiving hole;

inserting the HF conductor into the receiving opening in the insertion sleeve or into the receiving opening in the insertion sleeve and into the at least one solder deposit; or A3) preparing the terminal apparatus and the HF conductor to be received by:

a) inserting the insertion sleeve into the HF conductor receiving hole and placing the at least one solder deposit on the HF conductor; and inserting the HF conductor into the receiving opening in the insertion sleeve; and B) heating the at least one solder deposit until it is melted into a liquid.

16. Method for producing a plug-in connection according to claim 15, wherein in heating, an induction loop causes the at least one solder deposit to melt, and/or the at least one solder deposit is an annular solder deposit.

17. The terminal connection of claim 1 wherein when the at least one solder deposit is melted, the at least one melted solder deposit electrically contacts the HF conductor with the HF conductor receiving element.

18. An electronic device, in the form of an HF filter comprising a high frequency conductor (HF) and a terminal apparatus comprising:

an HF conductor receiving element comprising an HF conductor receiving hole for receiving the HF conductor;

at least one solder deposit for establishing an electrically conductive contact between the HF conductor and the HF conductor receiving element of the terminal apparatus;

an insertion sleeve comprising a receiving opening into which the HF conductor is inserted;

the insertion sleeve being inserted into the HF conductor receiving hole in the HF conductor receiving element via an insertion opening on a plug-in side;

wherein the at least one solder deposit is:

a) arranged in the insertion sleeve; and/or b) arranged on at least one end face of the insertion sleeve; and/or c) arranged on the HF conductor; and the insertion sleeve i. is undeformable; and/or ii. consists of a dielectric; and/or iii. is adapted, in terms of a circumferential lateral face thereof, to an inner face of the HF conductor receiving hole, is supported against the inner face of the HF conductor receiving hole, and is only displaceable in a longitudinal direction within the HF conductor receiving hole; and/or iv comprises at least one receiving channel, which extends inwards from the outside into the receiving opening, the at least one receiving channel being used for receiving the at least one solder deposit; and wherein:

the HF conductor receiving hole is formed in a resonator inner conductor of the HF filter;

the insertion sleeve is inserted into the HF conductor receiving hole in the HF conductor receiving element together with the at least one solder deposit; and the HF conductor is inserted into the insertion sleeve and soldered by the at least one solder deposit to the HF conductor receiving element.

19. The electronic device in the form of an HF filter according to claim 18, wherein:

the HF conductor is enclosed over at least part of the length thereof by a solid dielectric; or the HF conductor is enclosed over at least part of the length thereof by a solid dielectric which is enclosed over at least part of the length thereof by an outer conductor such that the HF conductor form an inner conductor of a coaxial cable which is to be or has been received; and the dielectric of the received coaxial cable being at least in part inserted into the HF conductor receiving hole of the HF conductor receiving element.

* * * * *